US005083389A

United States Patent [19]

Alperin

[11] Patent Number: 5,083,389

[45] Date of Patent: Jan. 28, 1992

[54] PANORAMIC DISPLAY DEVICE AND METHOD OF MAKING THE SAME

[76] Inventor: Arthur Alperin, 89 Blair Rd., Holbrook, Mass. 02343

[21] Appl. No.: 445,456

[22] Filed: Dec. 4, 1989

Related U.S. Application Data

[63] Continuation-in-part of Ser. No. 219,479, Jul. 15, 1988, Pat. No. 4,910,899.

[51] Int. Cl.[5] ..... G09F 1/08

[52] U.S. Cl. ..... 40/539; 40/124.1; 446/148

[58] Field of Search ..... 40/539, 124.1, 610; 446/147, 148, 149; 248/152, 174, 459

[56] References Cited

U.S. PATENT DOCUMENTS

| | | | |
|---|---|---|---|
| 2,121,156 | 6/1938 | Leigh | 248/174 |
| 2,133,336 | 10/1938 | Ziemmerman | 248/152 |
| 2,920,410 | 1/1960 | Angehrn | 248/124.1 |
| 4,773,622 | 9/1988 | Herlin | 40/539 |

FOREIGN PATENT DOCUMENTS

| | | | |
|---|---|---|---|
| 708230 | 4/1954 | United Kingdom | 40/539 |

*Primary Examiner*—Cary E. O'Connor
*Attorney, Agent, or Firm*—Wolf, Greenfield & Sacks

[57] ABSTRACT

A three-dimensional display device having a generally hemispherical configuration with a displayed image or reflecting surface on either or both of its inner concave surface and its outer convex surface. The device includes at least three portions which are curved and angled to create the hemispherical shape and approximate the horizontal and vertical span of human peripheral vision without significant distortion. The device may be constructed as a rigid device or as a pop-up device movable between a flat folded position and an expanded hemispherical position. The pop-up may be constructed as a stand-alone device or is insertable between the pages of a magazine, greeting card, or like device. A method is provided for taking a series of photographs to be joined along shared match lines to create a composite panoramic display on the hemispherical display surface. A camera fixture is provided for taking a series of pictures according to the method of the invention.

30 Claims, 10 Drawing Sheets

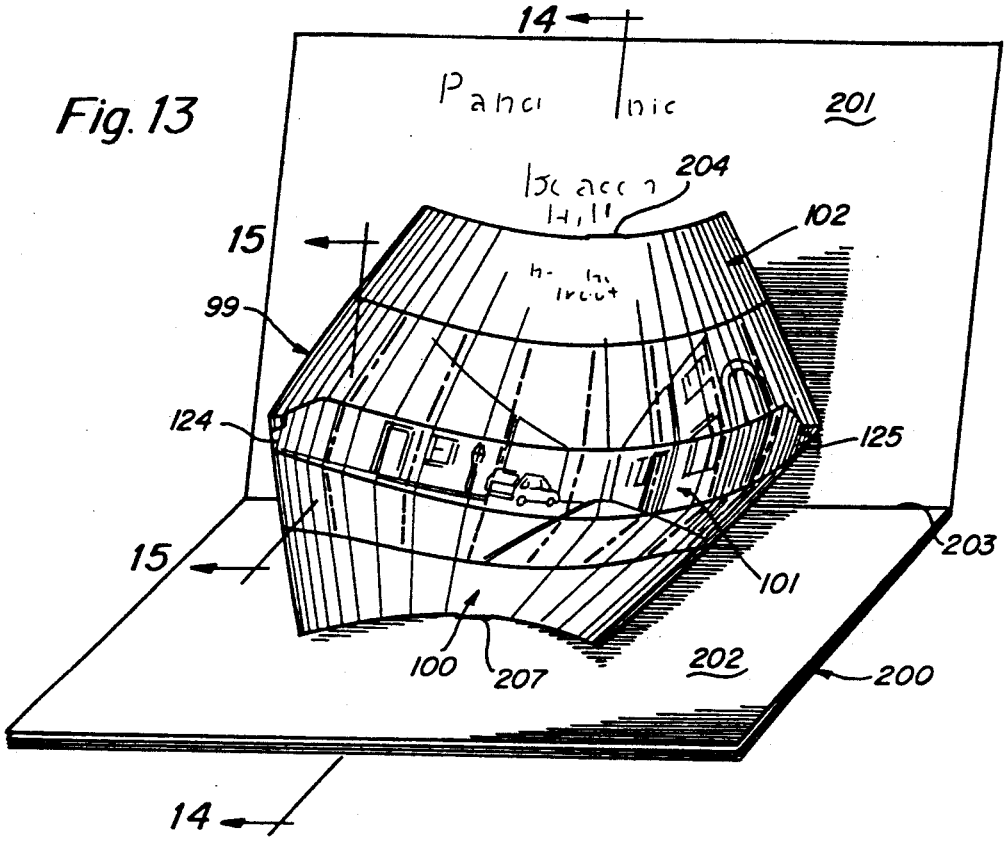
Fig. 13
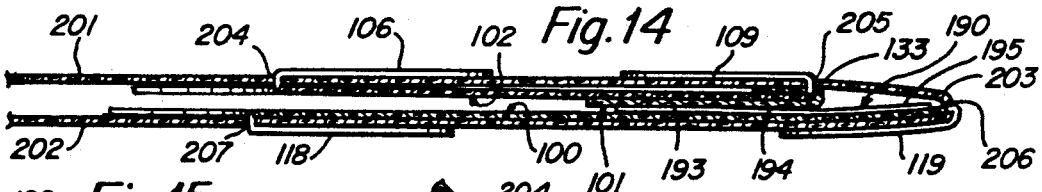
Fig. 14
Fig. 15
Fig. 17
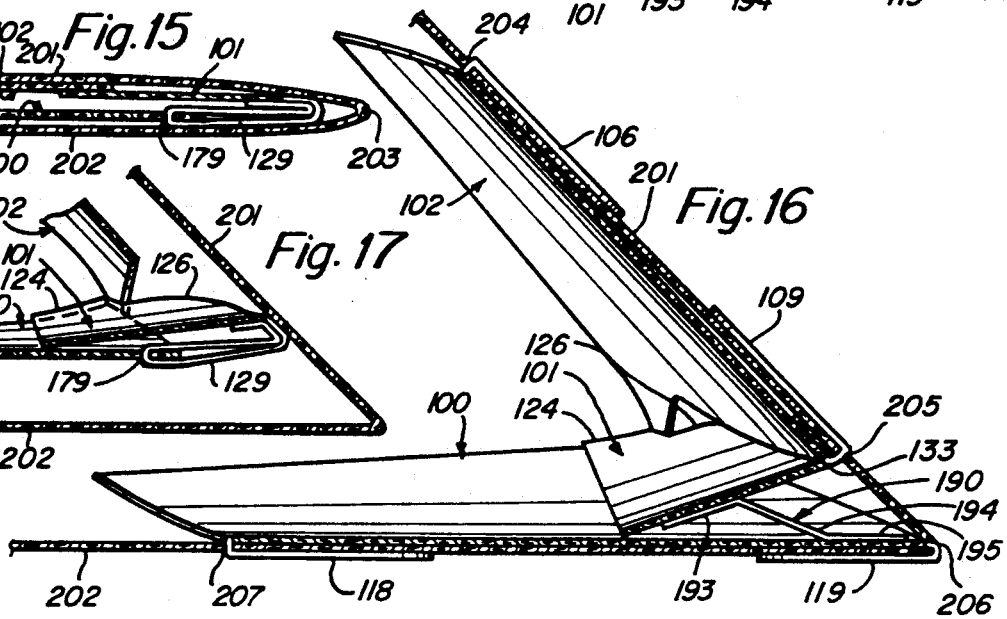
Fig. 16

Fig. 18
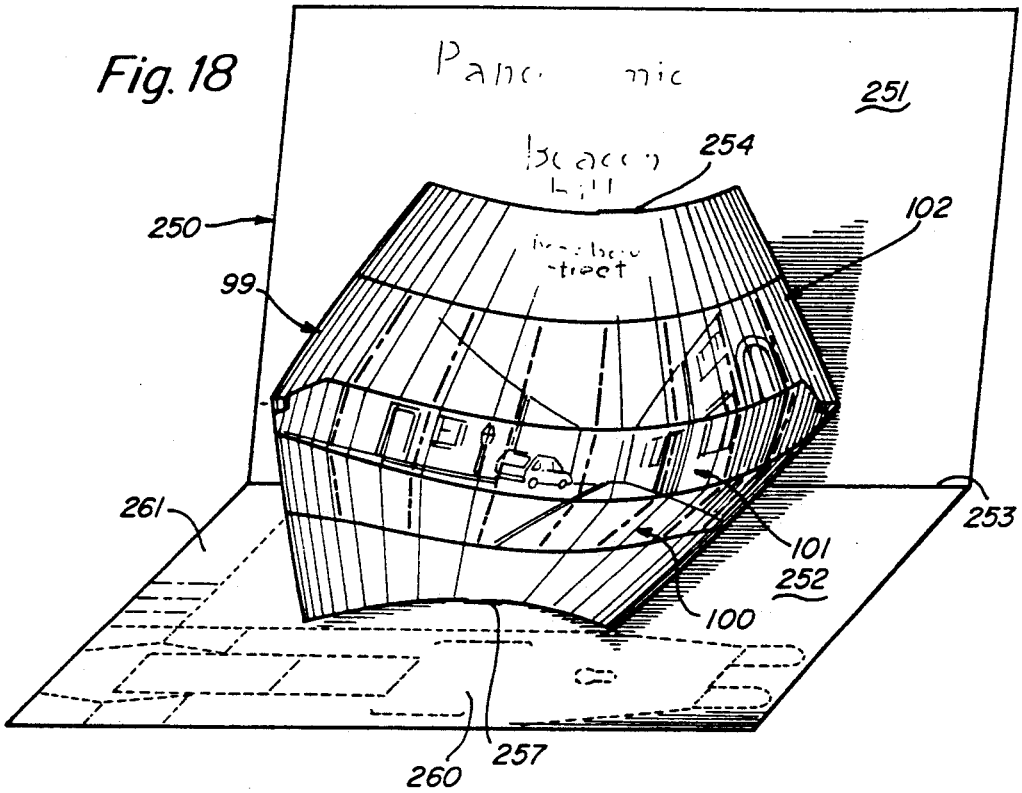
Fig. 19
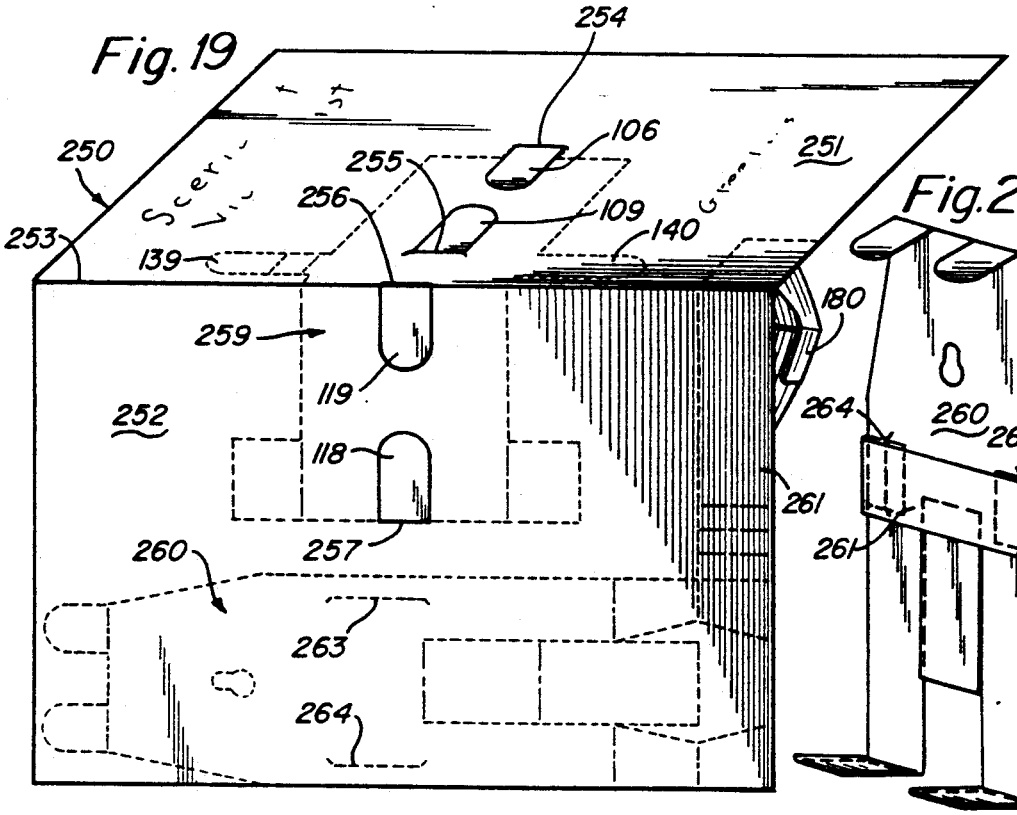
Fig. 20

Fig. 21
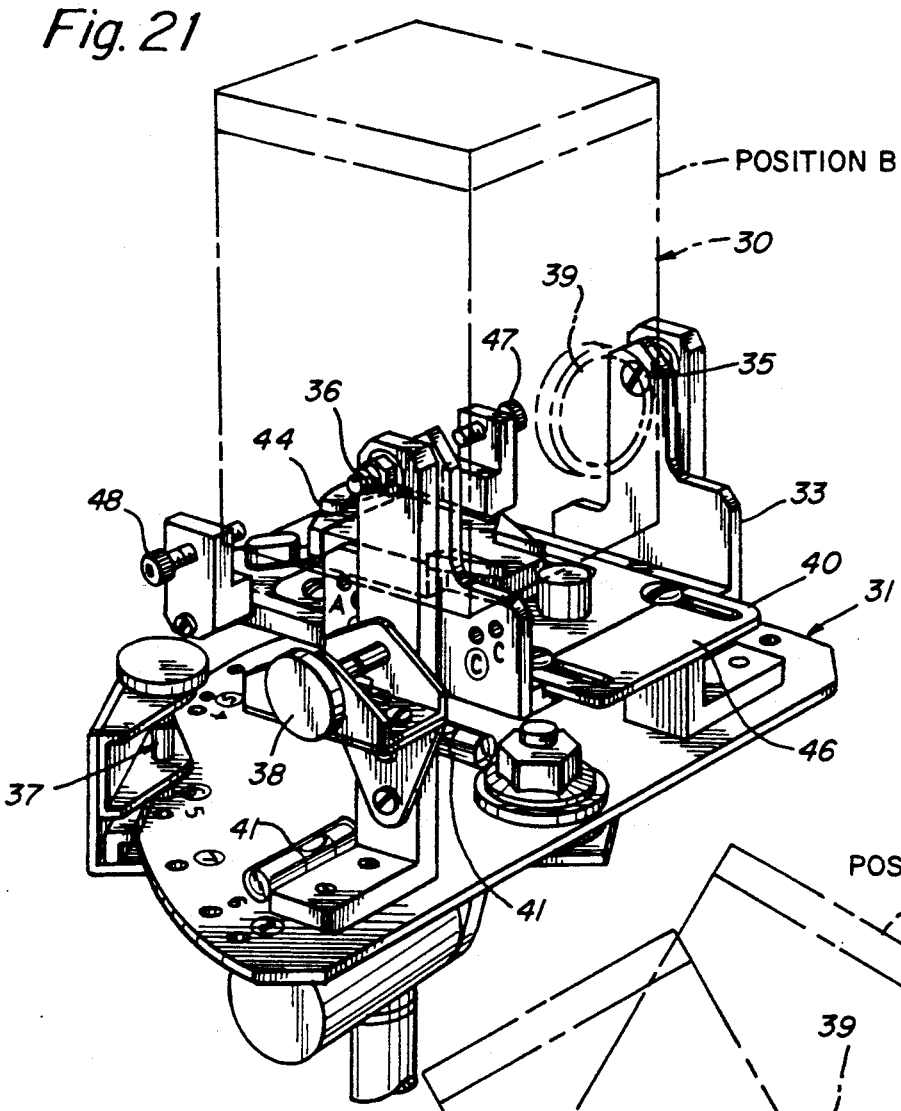
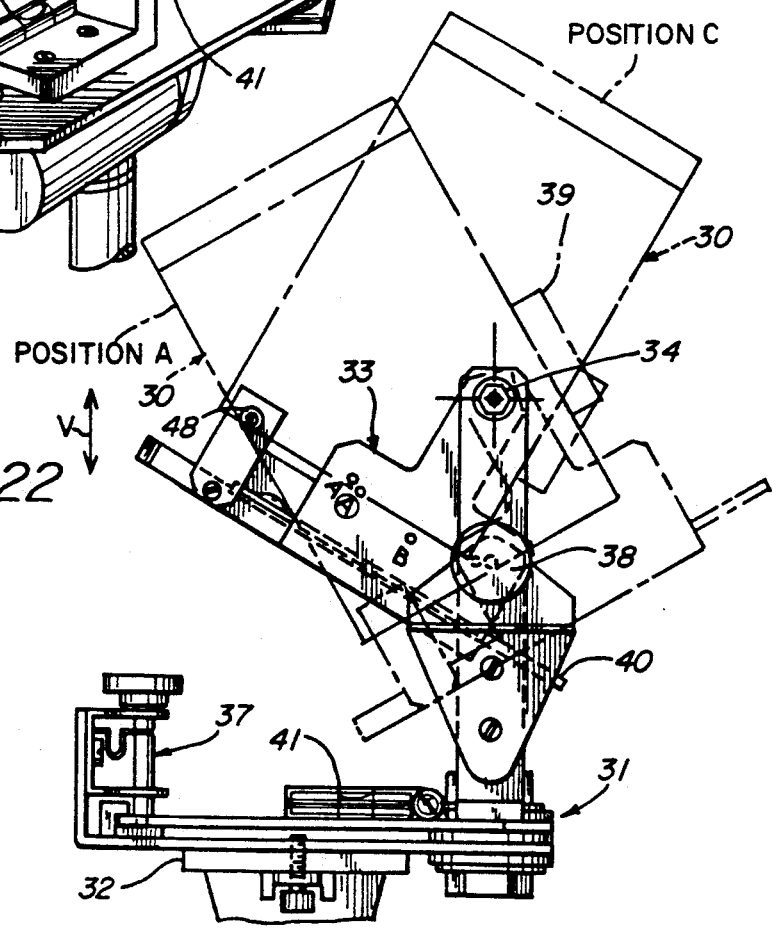
Fig. 22

PANORAMIC DISPLAY DEVICE AND METHOD OF MAKING THE SAME

This is continuation-in-part of Ser. No. 07/219,479 filed by Arthur Alperin on July 15, 1988 entitled "Pop-Up" now U.S. Pat. No. 4,910,899.

BACKGROUND OF INVENTION

This invention relates to a three-dimensional display device and method of making the same, and more particularly to a display device having upper, intermediate, and lower portions joined together to form a concave bowl with a generally hemispherical configuration; preferably, the portions are attached by joints which allow the device to be collapsed into a flat configuration.

Panoramic displays of photographs or other images are intended to approximate the horizontal and/or vertical span of human peripheral vision. Known panoramic displays and techniques for making the same have one or more drawbacks, which typically include distortion, limited span, high cost, or complexity.

One known technique is standard panoramic photography. While this provides angular coverage equal to human peripheral vision in the horizontal direction, approximately 180°, the vertical span is only on the order of 35°–45°, whereas effective human vertical vision is twice that, or more.

Another standard technique is a photograph taken with a "fish eye" lens. While "fish eye" photographs combine vertical span with horizontal span, they are misshapen and exhibit severe circular distortion.

Another known technique, which is complex and expensive, requires the pains-taking inlay of small "chips" of pictures in a mozaic on the concave surface of a truly spherical shaped bowl. This technique has been used by NASA to map planets. NASA uses a moving space craft that traverses the target and captures each single chip photo from a different geographical position, while for this invention each separate picture is taken from the same vantage point.

Another expensive technique is the audio-visual theater in which multiple projectors throw images on a suitably curved screen.

It is an object of this invention to provide a display device for viewing panoramic scenes which combines the vertical and horizontal components of human peripheral vision in a bowl shape that provides physical depth, similar to the way humans see, to produce a natural appearance of objects in the scene and which is relatively free of distortion.

Another object is to provide such a display device which is economical, i.e., it can be mass-produced at a low cost, affordable by most people.

A further object is to provide a three-dimensional display device for viewing a panoramic scene which can be collapsed into a flat position for storage.

A still further object is to provide a method for generating a series of overlapping photographs and a method of combining the photographs to form the display.

Another object is to provide a display device having a reflective surface for reflecting energy forms, particle beams, or waves.

Another object is to provide a display device which includes curved and angled portions and embodies an image or reflective surface that encompasses more or less than the human vision span.

SUMMARY OF THE INVENTION

The display device of this invention is a generally hemispherical device having a display on either or both of its inner concave surface and its outer convex surface. The device may be constructed as a rigid structure or as a pop-up structure movable between an expanded position and a flat collapsed position. The expanded pop-up device may constitute a stand-alone device positionable on a horizontal, vertical or inclined surface or it may be inserted between the pages of a magazine, greeting card, or other article wherein by opening the pages of the article the pop-up device is opened to its expanded position.

The display device comprises at least three portions, including an intermediate portion disposed between an upper portion and a lower portion and means are provided for connecting the upper, intermediate and lower portions together. The intermediate portion comprises a cylindrical segment having a cylindrical surface and a cylindrical axis. The upper and lower portions each comprise a conical segment having a conical axis which is coaxial with the cylindrical axis and having a conical surface which is disposed at an obtuse angle to the cylindrical surface. The planar surfaces of the outer, intermediate and lower portions are curved and angled to create an illusion of a generally hemispherical display surface.

The invention also includes a method of making a panoramic display device wherein a series of pictures are applied to the intermediate, upper and lower portions of a hemispherical display surface and are joined along their shared match lines to create a composite display. The method includes taking a first series of overlapping pictures while a camera having a fixed axis is pivoted to spaced positions along a second direction perpendicular to the fixed axis. A second series of overlapping pictures is taken while the camera, after being tilted upwardly to a first predetermined angle with respect to the fixed axis, is again pivoted to the spaced positions along the second direction. A third series of overlapping pictures is taken while the camera, after being tilted downwardly to a second predetermined angle with respect to the fixed axis, is again pivoted to the spaced positions along the second direction. The three series of pictures are then applied to the intermediate, upper and lower portions of the display device respectively and joined along their shared match lines to create a composite display.

The invention further includes a camera fixture pivotable in a first plane about a first axis and tiltable perpendicular to the first plane. The camera is mounted on a platform and means are provided for temporarily retaining the platform in a plurality of spaced pivot positions along the first plane. Means are also provided for temporarily retaining the platform at a first predetermined tilt angle with respect to the first plane wherein the platform can be moved to each of the spaced positions along the first plane. In addition, means are provided for temporarily retaining the platform at a second predetermined tilt angle with respect to the first plane while allowing the camera to be moved to each of the spaced positions along the first plane. The fixture is usable in the method of the invention for making the three-dimensional display device of the invention.

DETAILED DESCRIPTION OF THE DRAWINGS

FIG. 13 is a front perspective view of a magazine pop-up display device of this invention.

FIG. 14 is a cross-sectional view taken along section lines 14—14 of FIG. 13 showing the magazine pop-up fully folded.

FIG. 15 is a cross-sectional view taken along section lines 15—15 of FIG. 13 showing the magazine pop-up fully folded.

FIG. 16 is a cross-sectional view similar to FIG. 14 but showing the magazine pop-up partially opened.

FIG. 17 is a cross-sectional view similar to FIG. 15 but showing the magazine pop-up partially opened.

FIG. 18 is a front perspective view of a greeting card pop-up display device of this invention.

FIG. 19 is a rear perspective view of the greeting card pop-up display device of FIG. 18.

FIG. 20 is a perspective view of the outer support member of FIG. 19 partially assembled.

FIG. 21 is a perspective view of a camera in position B (in phantom) attached to a fixture for taking photographs for the display device of this invention.

FIG. 22 is a side elevation view showing the camera in positions A and C (in phantom).

DETAILED DESCRIPTION OF THE PREFERRED EMBODIMENTS

Rigid Display Device (FIGS. 1-4)

The display device 10 of this invention combines the vertical and horizontal components of human peripheral vision in a composite photograph, image, or scene (hereinafter "display" 11) and provides for the natural appearance of objects without significant distortion. Preferably, the display encompasses a visual span of at least about 5° about two perpendicular axes and up to about 360° about one axis. More preferably, the display encompasses about 180° in horizontal span and about 90° in vertical span, which, for practical purposes is the effective peripheral vision field of a human observer. Consequently, the display has the illusion of reality and of placing the viewer at the actual scene. As defined herein, display 11 is meant to include any photograph, compilation of photographs, drawing, reproduction, print, lettering, scene, image, graphics, inscriptions, reflective surface, or the like, wherein some visual or other image, panoramic or otherwise, is contained or can be viewed. The reflective surface can be used for reflecting energy forms, particle beams, or waves, with or without an image to be viewed.

Figure 1:
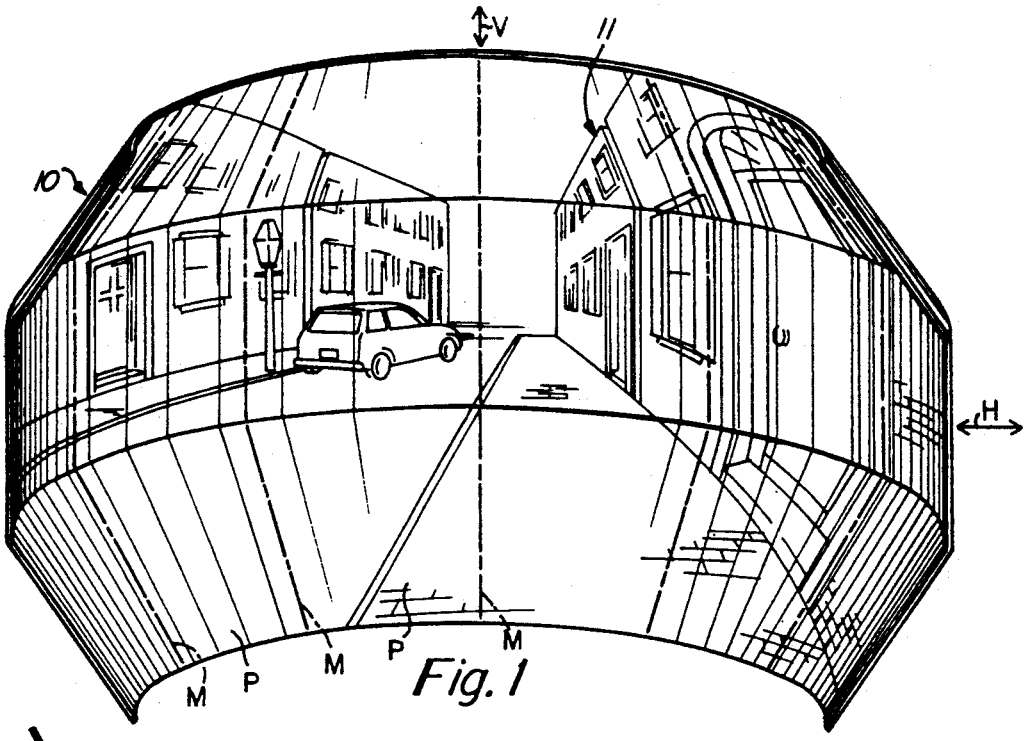
FIG. 1 is a front and top perspective view of a rigid display device of this invention, having 18 picture panels.
Figure 3:
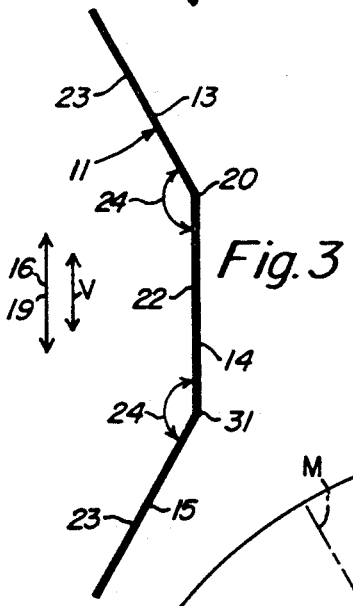
FIG. 3 is a cross-sectional view taken along the section lines 3—3 of FIG. 2.
Figure 2:
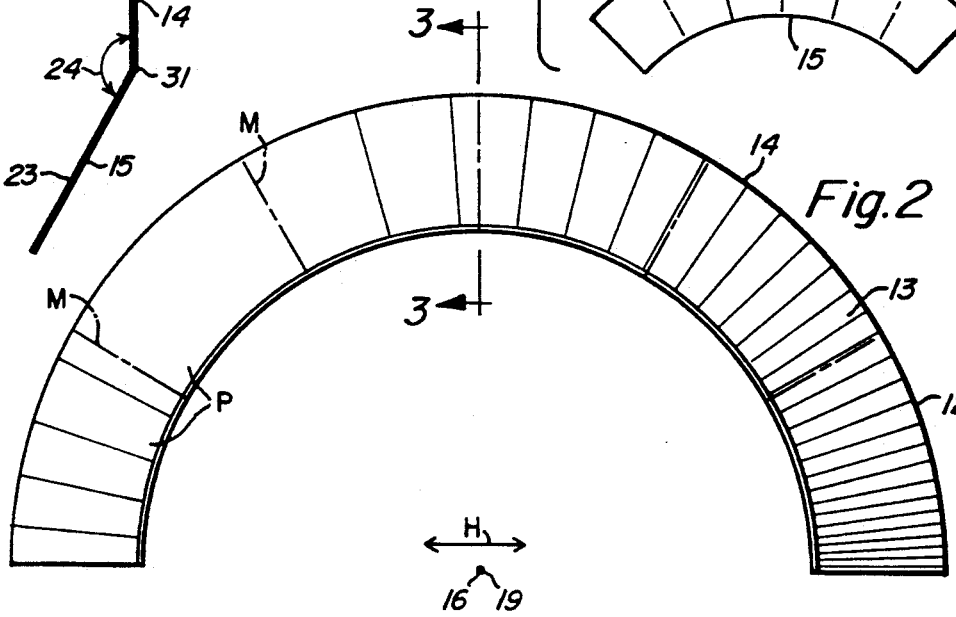
FIG. 2 is a top plan view of the rigid display device of FIG. 1.
Figure 5:
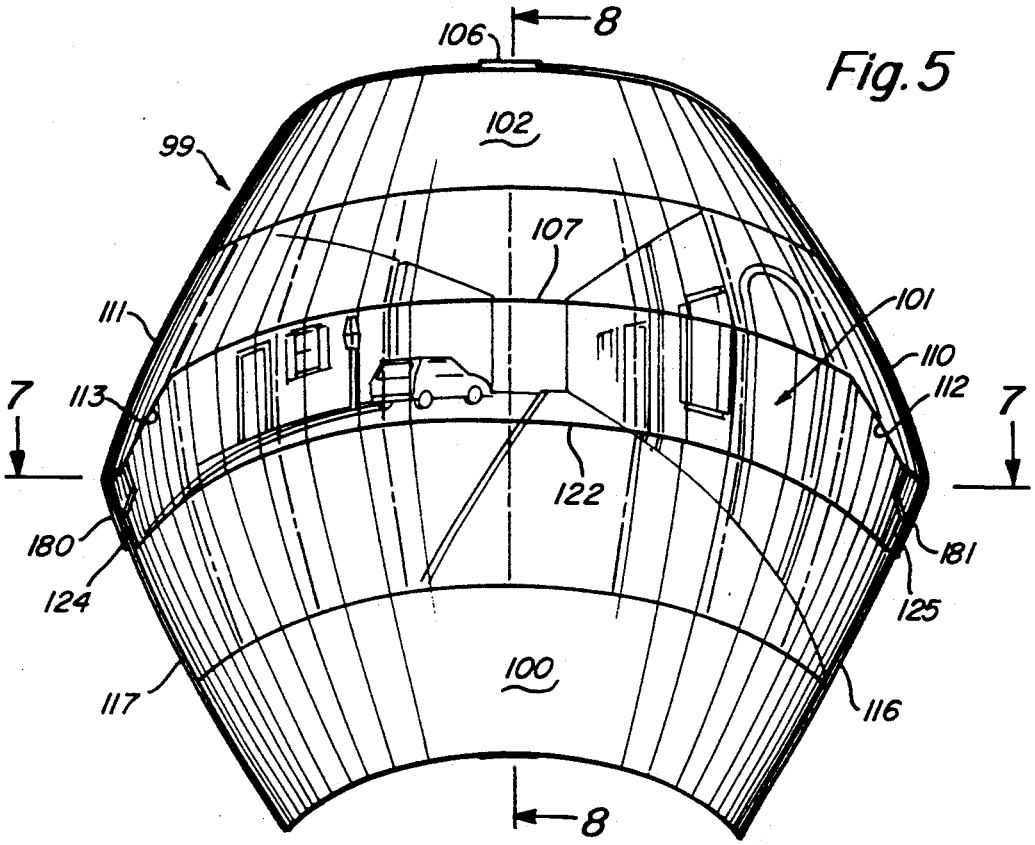
FIG. 5 is a front and top perspective view of a stand-alone pop-up display device of this invention, having 24 picture panels.
Figure 6:
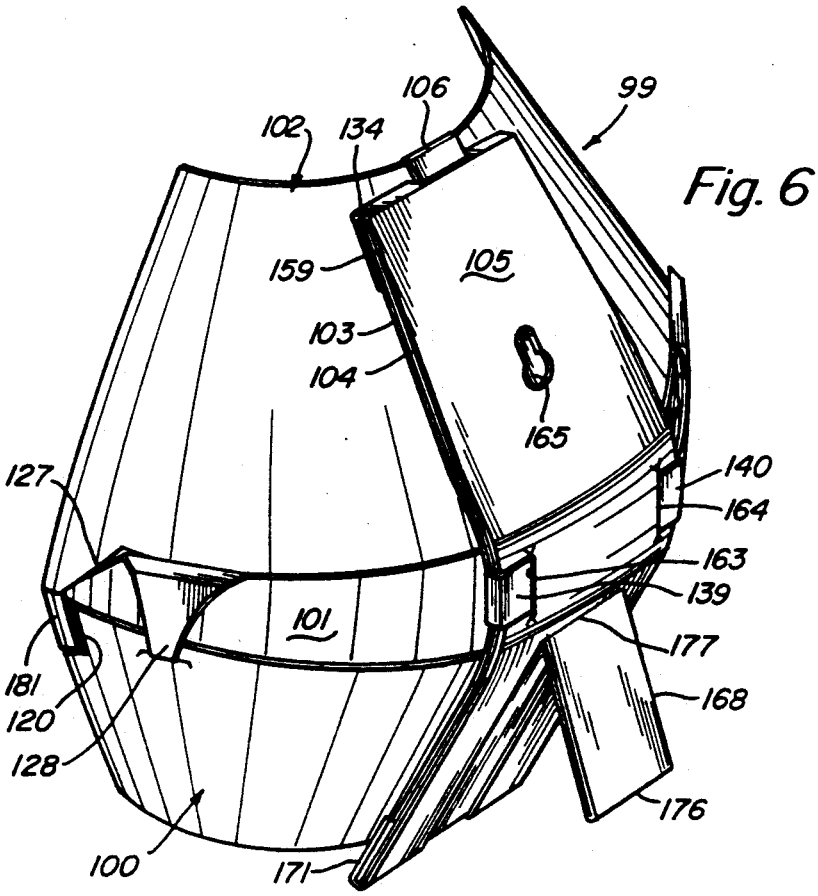
FIG. 6 is a rear perspective view of the stand-alone pop-up display device of FIG. 5.
Figure 7:
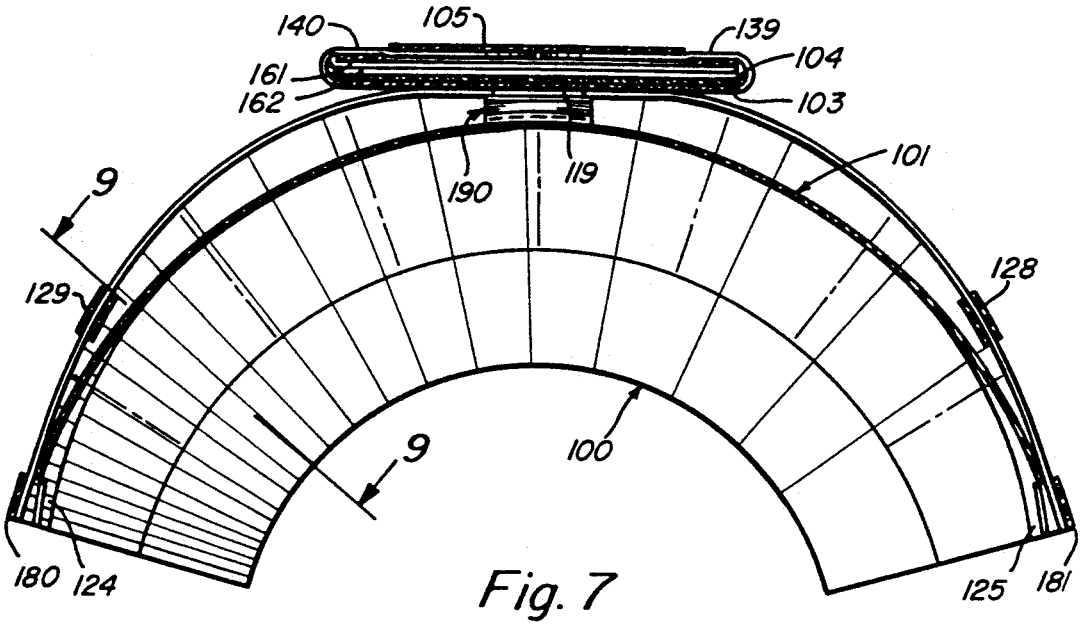
FIG. 7 is a plan cross-sectional view taken along the section lines 7—7 of FIG. 5.
Figure 9:
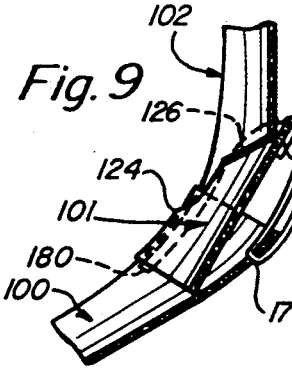
FIG. 9 is a cross-sectional view taken along the section lines 9—9 of FIG. 7.

This feeling of being at the scene is fostered by the shape of the display device 10, a unique configuration which curves toward the viewer both horizontally and vertically (see FIGS. 2-3). In the most common viewing orientation, the curve is literal in the horizontal direction H by describing the arc 12 of a circle (see FIG. 3), and in the vertical direction V the curve is illusory in comprising three flat planes 13, 14, 15 in vertical cross-section, although the planes are circular in shape horizontally (see FIG. 3). The combination of the horizontal circular curve and the vertical angles of the planes creates an illusion that one is peering into a concave bowl with a generally hemispherical configuration.

The display device is constructed of three portions which define the three surfaces 13, 14, 15 in vertical cross section. An intermediate portion 14 is a segment of a cylinder, having a cylindrical axis 16 and a cylindrical surface 22 (FIG. 3). which segment extends approximately half-way around the circumference of the cylinder (about 180°). This portion can be oriented to the viewer in any spatial angle, but is generally maintained horizontal, i.e., with the cylindrical axis 16 held vertical (see FIG. 3). Alternatively, the intermediate portion 14 can be maintained vertical, i.e., with the cylindrical axis 16 held horizontal (not shown). "Vertical" and "horizontal" are referred to the earth's horizon. Although both horizontal and vertical orientations are the principal embodiments, the horizontal orientation (vertical axis) is more common and hereinafter, unless otherwise indicated, the device will be described in a horizontal orientation.

Joined to each of the upper and lower (normally longer) edges 17, 18 of the intermediate portion 14 are upper and lower portions 13, 15, respectively. The upper and lower portions each constitute a segment of a truncated cone having a conical axis 19 and a conical surface 23, wherein the segment has the same circumference as the intermediate portion (see FIGS. 3-4). Each cone axis 19 is coaxial with the cylinder axis 16 (FIGS. 2-3). The joints 20, 21 to the intermediate portion 14 are at the larger diameters of the cone segments and are the same lengths as the edges 17, 18 of the cylinder segment 14. The conical surfaces 23, 23 are each disposed at an obtuse angle 24 to the cylindrical surface to form the generally hemispherical display device with a concave inner surface and a convex outer surface. The vertical image obtained by the vertical combination of the cylinder segment 14 and the two cone segments 13, 15 spans approximately 90° of human vision (FIG. 3).

In the preferred embodiment utilizing photographs, a composite picture is the display 11 on the inner concave surface of the device 10. In an alternative embodiment (not shown), the display could be presented on the external convex surface. The display 11 is derived from a series of overlapping pictures P (defined by phantom lines M in FIGS. 1, 2 and 4) taken one after the other while a camera pivots about a vertical axis to equally spaced horizontal positions. To achieve a panoramic appearance, the pictures are seamed together, side-to-side and top-to-bottom, at their shared match lines M and joints 20, 21.

This horizontal camera pivoting is done for each of the three portions of the display device. For the intermediate portion 14, the camera film plane is usually held vertical (perpendicular to the earth's surface — camera position B in FIG. 21). For the upper and lower conical segments 13, 15, the film plane is tilted up and then down with respect to the original vertical plane to focus on objects above and below the center objects— camera positions A and C in FIG. 22. This tilting does not change the positioning of each of the horizontal axes of the film planes, which axes remain parallel.

Figure 4:
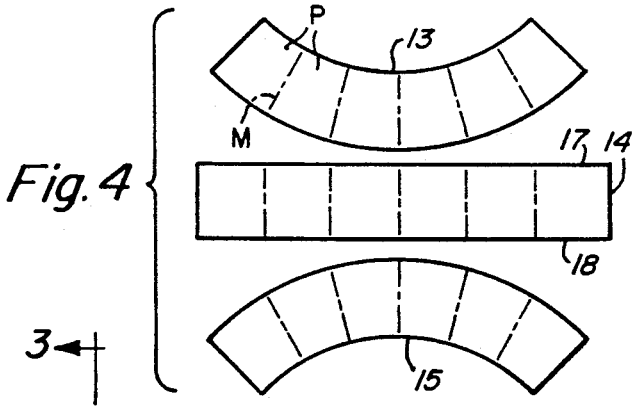
FIG. 4 is a plan view of the three main components of the display device of FIG. 1.

Each picture P on the intermediate cylindrical segment 14 is rectangular (i.e., a parallelogram all of whose angles are right angles, and having equal or unequal sides)—see the square picture panels on segment 14 in FIG. 4. The pictures P on the upper and lower conical segments are in the shape of a truncated triangle (or keystone) having a curved base and top, with the triangle base adjoining the cylindrical segment 14 (FIG. 4).

In alternative embodiments, additional cone segments may be joined to the outer edges of the upper and lower cones 13, 15 to increase the vision span beyond 90°. This is useful for photographing tall mountains or skyscrapers, especially closeup. Alternatively, a tall building can be displayed on the alternative vertical orientation of the device wherein the cylindrical segment has a horizontally-disposed cylinder axis 16; however, the horizontal panorama would then be limited to an approximately 90° span unless the foregoing additional cone segments are added.

Other alternative versions can vary the horizontal span from the preferred 180° to any other angle, including a full 360°, or, conversely, as small as the angle of view of the camera lens used in taking a single picture (e.g., 35°). This latter small angle is fixed by whatever combination of lens and film size is used.

The display device can be made as either a rigidly-assembled, non-collapsing member (hereinafter rigid display device 10 shown in FIGS. 1–4). or alternatively as a jointed pop-up member which can be collapsed (hereinafter pop-up display device 99 shown in FIGS. 5–20). In constructing either the rigid or pop-up display devices, each of the upper, lower and intermediate portions have "developments", i.e., they can be layed out flat on a suitable substrate (see FIG. 4). The development of the intermediate cylinder segment 14 is a rectangle. The developments of the upper and lower cone segments 13, 15 are a crescent, i.e. a portion of a circular disk. When joined along their edges as previously described, the rectangle and two crescents automatically take on the cylindrical and conical shapes described which gives the illusion of a concave hemisphere. The structure of the pop-up 99 is more complex and will be described later, after first describing the methods of taking the photographs and assembling the photographs to form a composite display.

Camera Fixture and Method Of Taking Photographs (FIGS. 21–24)

In order to generate the series of photographs P for the display 11, a camera 30 is positioned on a fixture 31 (FIG. 21) that sits on a tripod 32 or other fixed platform (FIG. 22). The fixture pivots and tilts the camera into the various required positions. In the embodiment described herein, the camera utilizes 2.25" square negatives.

Figure 23:
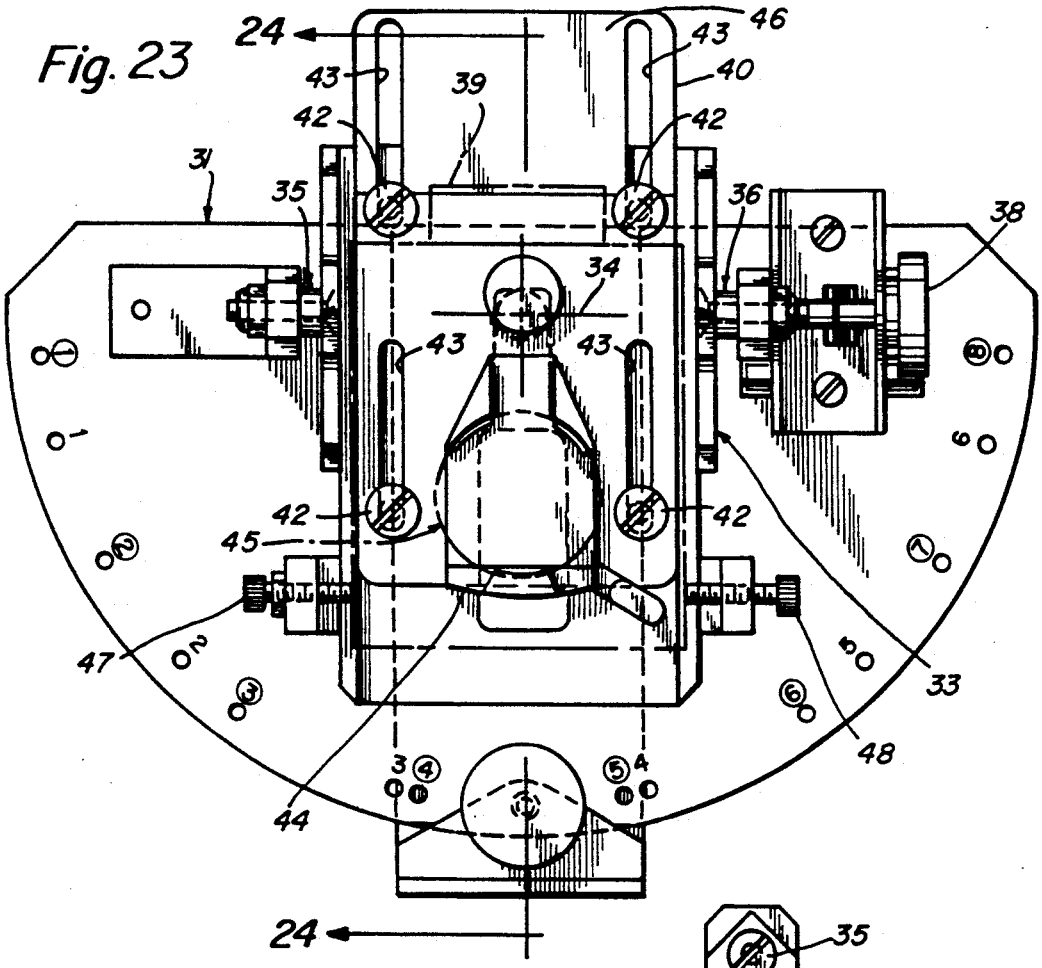
FIG. 23 is a top plan view of the fixture.
Figure 24:
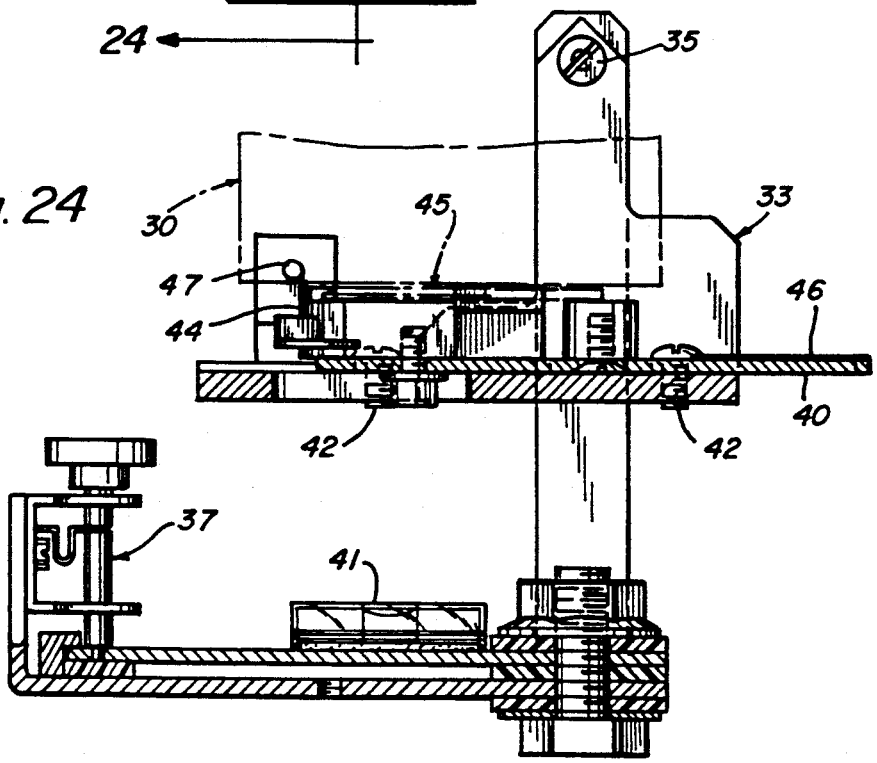
FIG. 24 is a cross-sectional view taken along the section lines 24—24 of FIG. 23.

The camera is fastened onto a carriage 33 on the fixture which can pivot horizontally and tilt vertically (see FIGS. 21–22 for vertical tilt positions A, B, C and FIG. 23 for horizontal pivot positions 1–8). Both orientations are independent of one another and can occur simultaneously. In the preferred embodiment, the fixture is designed to take either 18 or 24 separate pictures for a display device having a vision span approximately 180° wide and 90° high. However, there is no required number of panels (pictures) needed to make a display. Rather, the number is determined by the focal length of the lens used, the film size, and the desired appearance of the seamed-together pictures. However, there is a minimum number of panels required. For any combination of lens and film sizes, that minimum is the one that insures that adjacent panels overlap—i.e., without an overlap, there would be no match line to seam.

There is no required method for determining the angle of each horizontal pivot and vertical tilt of the camera. All that is required is that adjacent pictures overlap. It is preferred, however, that the up and down tilt angles be equal and that the horizontal angle subtended by each panel be the same. The up and down (vertical) tilt angles define the camera positions A and C with respect to horizontal axis 34 (lying between left and right axles 35 and 36) and about which the camera tilts (FIG. 22). Camera position B is defined at 0° vertical tilt (FIG. 21). The horizontal pivot angles are defined by camera holes 1–8 in a horizontal plane (FIG. 23). Equal pivot and tilt angles will produce square panels on the intermediate portion.

The number of picture panels affects the shape of the display device. For example, an 18-panel device of 180° width results in a deeper bowl shape (e.g., display device 10 of FIG. 1) then one of 24 panels, which is slightly shallower (e.g., display device 99 of FIG. 5). The 18-panel unit also subtends a slightly larger vertical angle making it look somewhat more bowl-like. The 24-panel unit is a little smaller (skinnier) in height in relation to its width, making it seem slightly more like a trough than a bowl.

The fixture 31 may have a spring-loaded plunger 37 which is pushed into holes 1–8 to position the camera horizontally for each shot, (FIG. 23) and an additional spring-loaded plunger 38 which is pushed into holes A. B. C to position the camera vertically for each shot (FIGS. 21, 22). In any sequence desired by the photographer, the camera is pivoted horizontally and tilted vertically to each shooting position established by the plunger holes 1–8 and A–C. This pivoting is done three times, one for each of the upper, intermediate and lower portions of the display. Dividing 18 panels by three produces 6 panels per horizontal position. A 24 panel device uses 8 panels per portion. In using 8 panels horizontally, versus 6, the camera is pivoted at a smaller angle If the tilt and pivot angles are the same (to get square panels in the intermediate portion rather than rectangular), a 24-panel device tilts less than an 18-panel device. It is the smaller vertical tilt angle which provides the skinnier/shallower shape.

All that is needed to add additional cones to the display device is to add more holes to the fixture in the vertical direction for the plunger 38 to engage. If the fixture is tipped 90° to create a vertical display, the additional holes generate side cones instead of top and bottom cones.

Alternatively, instead of plungers and holes, any "click-stop" mechanism for moving the camera into repeatable positions is acceptable. Examples would be detents and keyways.

Preferably, the fixture 31 rotates the camera horizontally and vertically about a nodal point of the camera lens 39 to bring the camera to rest for each shot in a defined repeatable position. The nodal point is a location within the glass elements in the lens which constitutes its optical center. Rotating about this point is preferable to avoid awkward distortions at the seam lines. The nodal point is determined by the lens designer and is available from the lens manufacturer. The nodal point should be located on axis 34; to achieve this position, camera 30 is attached to sliding plate 40 whereby camera 30 is adjustably positioned with respect to axis 34. Adjustable screws 42 are positionable in slots 43 in the sliding plate for positioning the camera with respect to the axis.

Another function of the fixture is to maintain the camera level. Two levels 41, 41 are mounted in 90° relation onto the fixture, one each for horizontal and vertical leveling of the pictures. Alternatively, the levels could be mounted directly to the camera or tripod.

The terms "horizontal" and "vertical" are used often herein and, as stated, refer to the horizon. However, that reference is not rigid and the fixture itself, and hence the camera, can he oriented to the horizon at whatever angle the photographer/artist desires. Except for a re-orientation of angle to the tripod or other mounting platform, the fixture functions in the same manner.

The camera 30 may be clamped onto the tilting carriage 33 by a spring-loaded, quick-release mechanism 44 which grips a boss 45 on the underside of the camera. Alternatively, a threaded stud could be used to mate with the threaded hole on the underside of the camera. The quick-release clamp sits on the sliding plate 40. The plate 40 is for repositioning each different lens to be used on the fixture with respect to the location of its nodal point. Matte black paper 46 is attached on the front of the plate to minimize reflection into the lens.

At the rear of the carriage 33 are two clamping screws mounted horizontally on each side of the camera. One screw 47 is fixed in position while the other screw 48 is adjustable and can rotate. These are an extra precaution to hold the camera rigidly in the same position for each shot with respect to the carriage. The screws bear against the sides of the camera. The rotating screw 48 moves into the camera to provide a locking action. Any type of clamp could be used instead of the screws.

Method of Picture Assembly

One technique for finding the match lines between panels utilizes moiré interference patterns. The match lines are the edges of a central portion of each photograph which is seen in the display, while the overlying margins (around the central portion) are discarded. To provide the moiré patterns, a checkerboard pattern is photographed onto adjacent negatives (called frames in photography). Because each checkerboard square, appears smaller or larger than the one next to it (because of perspective size alterations due to their locations from the frame centers), the location of the match lines between adjacent frames is where the squares on the neighboring frames are the same size.

If the neighboring negatives (or transparent positive enlargements thereof) are superimposed on a light box, or superimposed as projected images, sliding them over each other quickly identifies the same size squares. This happens when squares centered on, or next to, the match line suddenly make up a complete column or row of all-opaque squares with little, or no, light passing through their adjacent edges.

The match line is located along the one horizontal or vertical line where the least light is transmitted between squares. This single, totally opaque, row or column is the interference moiré pattern generated by the intersecting checkerboards. The location of this line is then measured from the negatives ' edges. These measurements are used to define lines on the photo prints, which prints are also printed with the negative edges showing before they are trimmed to size.

However, on the upper and lower conical portions, the match lines are not parallel to the negatives' edges as they are on the intermediate portion. The line locations on the upper and lower portions are found by loft-line measurements from the neqatives' edges along the extent of the match line.

Another technique for finding match lines is the use of opaque overlays with properly shaped cutouts in their centers ("masks"). These are sandwiched with the neqatives' images either during printing or afterwards, and are indexed to the negatives' or prints' edges. Note: this is only "half" a technique; it is necessary to use another technique initially to determine the location of the match lines which are then transferred to the masks as the edges of the cutouts. From then on the masks are used without further need to locate match lines.

Another technique for locating match lines utilizes geometrical layouts of opaque photo prints. The following numbered steps for rigid display devices are used for finding the match lines and assembling the display device using original photo prints, or for the final mechanical for printing-press reproductions The press reproduction steps may be omitted if the original photos will be mounted on the display device.

The Craft Method Of Geometrical Layout (1) Print all photos the same size (the size required for the device or mechanical) and with their edges showing.

(2) Because all frames are made at the same camera settings for exposure and focus, all prints, as made in the darkroom, must be the same exposure and focus and be printed at the same time.

(3) Mark a panel sequence number for each frame on the rear center of each print (for convenient identification).

(4) Mark each print's vertical center line non-indelibly on its front, being careful not to engrave the surface.

(5) Trim off the excess borders of the prints exactly at the picture edges.

(6) With prints of the intermediate position right-side up, lay them on a flat surface with their bottom or top edges against a straight edge, and with one print overlapping the next in proper frame sequence.

(7) Position the overlapping edge of each print to coincide with the corresponding point in the image on its neighbor (or otherwise measure from the print edges to the corresponding points) Fasten the prints together temporarily (without harm to the prints).

(8) Cut prints apart at the the exact center of the overlap—this is the real match line of the adjacent panels. (Note: If there is any image distortion from the lens used, an additional small sliver of picture might be duplicated on each side of the cut. If so, trim off one-half the duplication on each print, i.e., the halves opposite each other.)

(9) Remove the temporary fastenings.

(10) Refasten the prints temporarily, without harm, into a long strip with their cut edges butted. Align the matching images on adjacent frames. Do not cut off the ends of the two outer prints to make them equal in width with the inner prints. To obtain a smaller span of image than was actually captured on the negatives, cropping can be accomplished during a printing press reproduction process (see step 29). Do not put any materials (not to be used for mounting the strip onto its substrate) on the rear of the strip.

(11) Repeat steps 7,8 and 9 for the vertical matching of the upper and lower conical portion prints with the prints on the intermediate portion (i e., the strip created at step 10). Before cutting, line up their vertical center lines (marked per step 4) keeping the pictures in a vertical straight line without a bend at the junctions of the center lines or coincident picture edges.

Also, before cutting, record for each print the measurement of where each cutting line is from the closest horizontal edge. These are given to the printer to indicate the window of picture to be reproduced from the full image captured during photography.

(12) Mount the intermediate strip temporarily onto a backing substrate—an easily curvable substance.

(13) Remove the temporary fastenings holding the intermediate strip's pictures together.

(14) Remove any unwanted portions of the substrate. Note: one will be assembling a trial or permanent display device at a later step; therefore, the substrate must be trimmed off at the finished edges of the pictures.

(15) Repeat steps 7 through 10 for the horizontal matching of the conical portions' prints with each other. The shape of the strip of butted and fastened pictures will be a crescent rather than a straight strip per step 10.

Note 1: If there should be a sliver of duplicate image on each side of the match line after the prints are cut apart per step 8, do not yet trim off the duplication as called for by that step. Any needed trimming will be done later.

Note 2: Much of the time the prints for the conical portions will show only clear sky in the upper cone and smooth textures in the bottom cone, such as water, grass, sand, etc. When this happens there will be no corresponding image points on which to align the neighboring pictures, as called for by step 7. To avoid this dilemma, photograph a subject that does have the needed detail in every picture. Cut the resulting prints in accordance with these instructions (with particular attention to step 22) and use the trimmed prints as templates for the future. Before cutting the usable portions of the prints away from their edges, record where the usable portions are with respect to those edges so that the templates can be positioned properly on the later sets of pictures you will be working with. (16) Temporarily mount the crescents obtained in step 15 onto a clean, smooth surface that can be used as a drafting table. (17) Draw extensions of the match lines to the point they intersect. (18) Using the intersecting point as the center of a circle, swing an arc on the crescents coincident with each crescent's longer edge at the intersection of the edge with the pictures' center lines. Trim off the straight edged portion of each print at the arcs leaving the crescents with a continuously curving edge the shape of an arc of a circle. Also, determine the radius of the arc to be cut at the narrow end of the crescents. (19) For later information for the printer, record the radii of the arcs in step 18. (20) Repeat steps 12, 13, 14 for the crescent prints. (21) Temporarily assemble into the concave device shape the two crescent portions and the intermediate portion so that their horizontal match lines butt. Be sure the vertical center lines of all the prints align (see step 22).

(22) If the vertical center lines (per step 21) do not align, judge what action is needed to make the best compromise for appearance.

For example, if the center lines on the intermediate portion are closer together than their counterparts on the conical portions, dismount the conical portion prints and trim off some or all of any duplicate image on both sides of their horizontal match lines, then temporarily remount the prints.

If, on the other hand the conical portions' center lines are closer together than their counterparts on the intermediate portion, reprint the pictures for the conical portions with a slight enlargement (or the intermediate portion pictures with a reduction), enough to compensate. One can judge the enlargement or reduction needed by making sufficient sets of reprints and refitting the portions of the structure until one achieves the best compromise.

Alternatively, one can avoid reprinting for enlargement or reduction and adjust do the best refitting possible as a craftsman. Some trial and error is required to understand what is obtained from the particular camera fixture used, the lens used, and the positioning of the camera with respect to the nodal point. Part of this judgment will include how much to retain of any image duplication on both sides of the horizontal match lines and how much to cut off, and from what pictures.

Note: If any prints are to be reprinted, ALL prints must be reprinted at the same time to assure consistency of size, density, focus, color balance, paper response, chemistry action, etc.

(23) After reaching the best compromise at step 22, repeat steps 10, 12, and 13 for the crescent portion strips if they are not mounted at this point (mounting both the intermediate and crescent strips permanently if one is making a rigid display device of original prints). Prior to mounting the crescents to their substrates, cut the arcs at their narrower ends using the radius established at step 18.

(24) Remove any unwanted portions of the substrates.

(25) Repeat step 21 to check that all is well, and that the center lines align. If one is making a rigid display of original prints, make the assembly permanent (and remove any indication of picture center lines and any other unwanted construction material). Also, if this is a permanent display device crop the horizontal width of the display prior to assembly per step 29.

(26) For the final mechanical, reprint every picture at the size determined proper above, repeating steps 1, 2 and 3.

(27) Repeat step 4, but only as small index marks (approximately ≦0.10 inch long) at the edges of the pictures instead of as full center lines. These are for the printer s use for any necessary alignment. This time the marks must be indelible— engraving would cause no problem.

(28) Repeat steps 5 through 10, 12, 13 (for both the intermediate and crescent strips), 15, and 20. For repetitions of step 12 mount the strips either temporarily or permanently as required by the separator or printer. Substrates need not be curvable.

(29) One now has a complete set of mechanicals for use by a separator or printer. One also has all the measurement information on record for the printer to isolate the portions of the mechanicals that will actually be printed (steps 11 and 19). Additionally, tell the printer whether the butts between frames should be retouched out, and how much horizontal span to crop out of the intermediate portion, where on the pictures the span is located, and where to crop the crescent portions to match. The outer crop lines on the crescents are extensions of the lines from the center of the circle (steps 17 and 18) to the matching points of the image on the intermediate portion.

The Mathematical Method Of Geometrical Layout

Alternatively, a mathematical method can be used for finding the match lines and assembling the device or final mechanical. The mathematical method involves steps 1m, 2–14 as previously described, and 15m–38m as follows:

(1m) Print all photos with their edges showing. The size of the prints depends on the size of the display device with original prints or mechanicals to be produced. The prints used for the crescents making up the conical portions should be slightly larger than the prints for the intermediate portion. The formula for enlargement is as follows: Where:

$E_1$ is the enlargement factor (multiply the length of any edge of the intermediate portion prints by this factor to obtain the length of the same edge for the conical portion prints)

P is the number of prints, horizontally, in a complete circle the camera fixture would provide if it pivoted a complete 360° while taking a picture at each "click stop" (360° divided by the angle of horizontal pivot for each picture =P)

Theta is the angle in degrees of vertical tilt of the camera fixture for upper and lower conical portions Therefore:

$$E_1=\{0.3183098\times P\times \tan[(180^\circ\times \sin\ theta)\div P]\}\div \sin\ theta$$

(2)–(14) as previously described.

(15m) Note: This step, and steps 16m through 19m, may be substituted for step 11 if the angles of horizontal pivot and vertical tilt of the camera fixture are equal (making a square of the intermediate portion pictures) and if the tolerance difference between the pivot and tilt of the fixture is too insignificant to make a discernable difference in the pictures.

Determine the average horizontal width of the frames on the intermediate strip. This is also the vertical height of the intermediate strip that will make up the final display. Record this information for later use by the printer.

(16m) Cut out from the initial intermediate strip a narrower final strip whose height was found in step 15m. The discarded strips cut from each edge of the intermediate strip must be calculated to be the same width.

Record the calculated width of the discarded strips for the printer to define the window of picture to be reproduced from the full image captured during the photography.

(17m) Mount the intermediate strip temporarily onto its substrate, an easily curvable material (same as step 12).

(18m) Remove the temporary fastenings holding the intermediate strip s pictures together (same as step 13).

(19m) Remove any unwanted portions of the substrate (same as step 14). Note that one will be assembling a trial or permanent display device at a later step, therefore the substrate must be trimmed-off at the finished edges of the pictures.

(20m) On suitable material, such as paper, draw two parallel semicircles (arcs) from the same center, one of a shorter radius than the other. Calculate the shorter radius ($R_1$) as follows:

Where W is the average width of the pictures in the intermediate strip (10 or 15m), and P and theta are as in step 1, $R_1=(0.1591549\times W\times P)\div \sin$ theta.

The longer radius ($R_2$) of the outer arc $=R_1+$the width of one of the discarded edge strips in step 11 or 16m.

One will need two sets of these arcs, one for each conical portion, so repeat the foregoing a second time.

(21m) The angle subtended by the arcs in 20m at their center is variable, depending on the desired finished angle of the horizontal span of the completed device (e.g., 180°, 150°, etc.). Where omega is the desired finished angle in degrees of the horizontal span, and there is an in step 1. sigma (the subtended angle in degrees)=omega×sin theta. Draw the boundaries of this angle across the two arcs in both sets. Record this information for later use by the printer.

(22m) Bisect the angle drawn at 21m with a radial line drawn across both arcs (both sets).

(23m) Determine and note the vertical center line of the intermediate strip. If the center is not a butt between pictures, the center line must be marked non-indelibly on the appropriate picture's front without engravinq the surface. If the center line is a butt, the center need not be marked for later use, just note where it is.

(24m) Holding one edge of the center strip (a) at 90° to the drawing surface of one of the sets of arcs, (b) in contact with the surface along the length of the intermediate strip. (c) congruent with the curve of the arc with the shorter radius, and (d) with the center line of the strip coincident with the bisector at 22m, make a mark at the arc locating the position of each butt between the pictures and for the center line of each picture.

(25m) Through the center of each mark made at 22m draw radial lines from the center of the arcs across both of them. The lines need not be drawn to the center as long as their lengths from the outer arc toward its center is equal to the vertical height of a conical portion print (across its edges before any print trimming has occurred) plus an extension at each end of approximately 0.10 inch.

(26m) Taking the conical portion prints which will abut the edge of the intermediate strip that was placed on the drawing surface (24m), fasten the prints temporarily to the surface, right-side up (without harm to the prints). If one used steps 15m and 16m, have the abutting edge of the prints coincident with the outer arc. If one used step 11, place the edges of the prints coincident with the inner arc. Keep the center line of each print congruent with the radial line (23m) that represents the print's center line.

(27m) Cut prints apart on the radial lines representing the butts between the intermediate strip's pictures and on the subtended angle boundaries of step 21m (do not remove the temporary fastenings in 26m; keep the prints fastened down unless one must separate them per instructions in the other paragraphs in this step). Discard the cut-off overlaps. The remaining pictures are now in the shape of a crescent rather than a straight strip per step 10. If there should be a sliver of duplicate image remaining on each side of the match line, do not yet trim off the duplication as called for by step 8. Any needed trimming will be done as indicated below.

If there are any inaccuracies in the equipment, dexterity, or technique, coincident images on either side of the butt lines of the prints might not align. Reprint the pictures and coincide print edges with their corresponding image points as in step 7. But if this is done, the prints' center lines might not align with their associated radial lines (25m); because they should, as much as possible, reposition all prints together as a whole for the best compromise appearance. Make and refit sufficient sets of reprints until satisfied with the compromise. Note: If any prints are to be reprinted, ALL prints must be reprinted at the same time to assure consistency of size, density, focus, Color balance, paper response, chemistry action, etc.

However, much of the time the prints for the conical portions will show only clear sky in the upper cone and smooth textures in the lower cone, such as water, grass, sand, etc. When this happens there will no corresponding image points on which to align the pictures, as called for by step 7. Prior to facing this dilemma, one should purposely photograph a subject that does have the needed detail in every pictures the resulting prints in accordance with these instructions and use the trimmed prints as templates for the future. Before cutting the usable portions of the prints away from their edges, record where the usable portions are with respect to those edges so that the templates can be positioned properly on the later sets of pictures one will be working with.

Do the best refitting as a craftsman. One will need some trial and error to understand what one is obtaining from the particular camera fixture used, the lens used, and the positioning of the camera with respect to the nodal point. Part of this judgment will include how much to retain of any image duplication on both sides of the horizontal match lines and how much to cut off, and from what pictures.

(28m) Refasten temporarily the crescent's prints, without harm, with their cut edges butted so they would stay together if removed from the paper.

(29m) Cut a continuously curving edge on the crescent coincident with the arc of shorter radius ($R_1$at 20m).

(30m) Cut an arc of an appropriately desired radius at the narrower end of the crescent. For later information for the printer, record the radius of the arc.

(31m) Remove the crescent from the paper and remove any temporary fastenings which held the prints to the paper. Do not put any material (not to be used for mounting the crescent onto its substrate) on the rear of the crescent (32m) Repeat steps 12, 13, and 14 for the crescent's prints.

(33m) Using the long edge of the intermediate strip opposite the one used at 24m, repeat steps 24m through 30m for the other conical portion's prints.

(34m) To assure that all is well, temporarily assemble into the concave shape device the two crescent portions and the intermediate portion so that their horizontal match lines butt. Be sure, as much possible, the vertical center lines of all the prints align (see steps 27m). If one is making a rigid display device of original prints, make the assembly permanent (and remove any indication of picture center lines and any other unwanted construction material).

(35m) For the final mechanical, reprint every picture, repeating steps 1, 2 and 3.

(36m) Repeat step 4, but only as small index marks (approximately $\leqq$0.10 inch long) at the edges of the pictures instead of as full center lines. These are for the printer's use for any necessary alignment. This time the marks must be indelible; engraving would cause no problem.

(37m) Repeat steps 5 through 10, 12, 13, and, for both crescents, steps 21m through 28m (except do not cut at the boundaries of the subtended angle) and steps 12 and 13. For repetitions of step 12 mount the strips either temporarily or permanently as required by the separator or printer. Substrates need not be curvable.

(38m) One now has a complete set of mechanicals for use by the separator or printer. One also has all the measurement information on record for the printer to isolate the portions of the mechanicals that will actually be printed (steps 11, 15m, 16m and 30m). Additionally, tell the printer where to locate on the pictures the subtended angle boundaries of step 21m, where the matching cropping of the intermediate strip is located, and whether the butts between frames should be retouched out.

Method Of Assembling The Pop-Up

The pop-up display device 99 of this invention can be provided within a magazine, greeting card, or similar article having a bound or folded edge, or as a stand-alone device.

The Stand-Alone Pop-Up (FIGS. 5–12)

Figure 10:
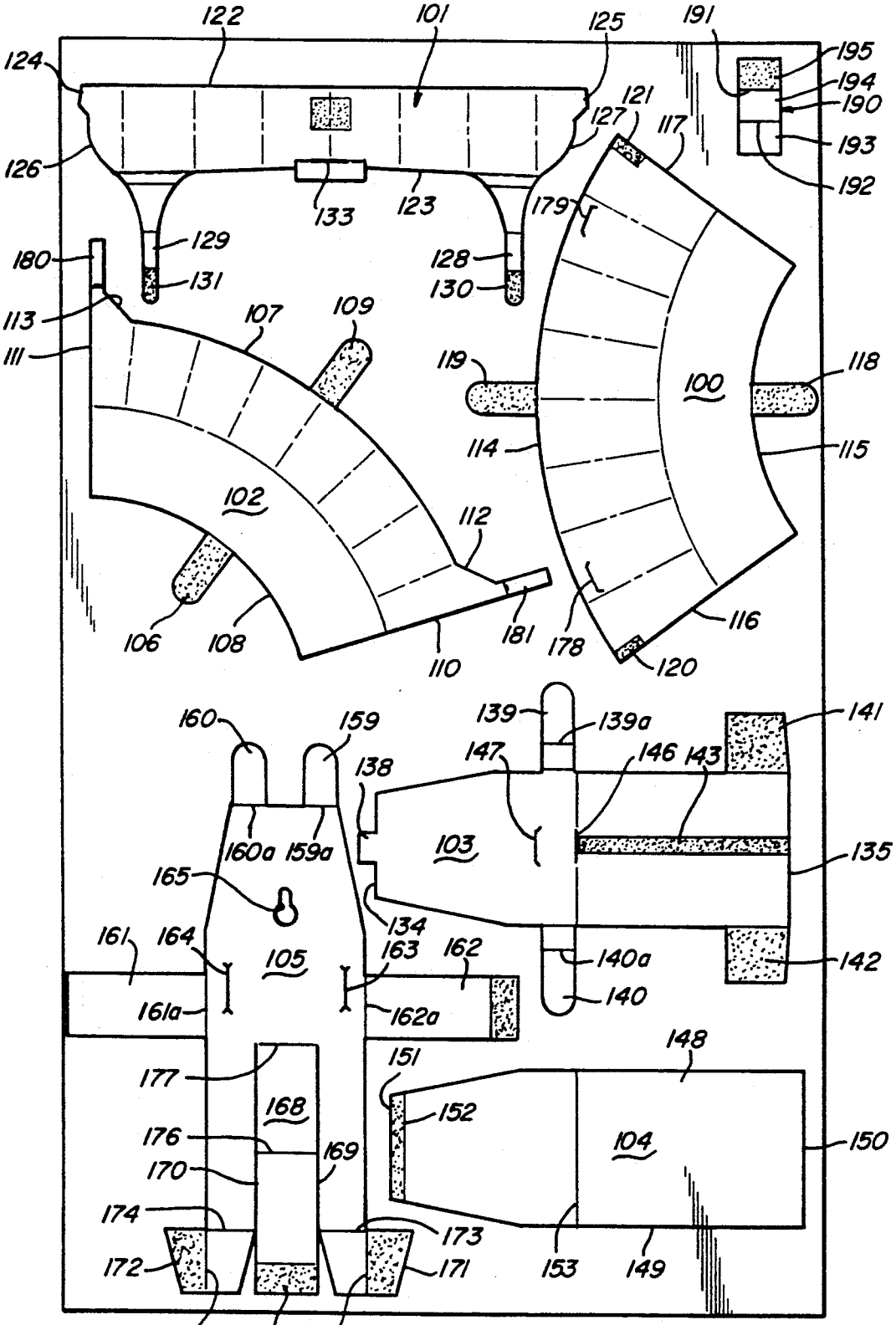
FIG. 10 is a plan view of a sheet containing the punch-out components for the stand-alone pop-up display device of FIG. 5.

The components of the stand-alone display device can be provided as frangible (i.e., punch-out or cut out) components from a single sheet of paper as shown in FIG. 10. Alternatively, the sheet could be made of plastic, fiber, metal, wood, paper or a composite thereof. The components include lower portion 100, intermediate portion 101, upper portion 102, inner support 103, outer support 105, and optionally, intermediate flap 104 and center tab 190. FIG. 10 shows the rear side of components 100, 101, 102 and 190 and the front side of components 103, 104 and 105; the shaded areas have glue so that all glue areas can be printed on the same side of the sheet after the photos are printed on 100 101 and 102.

Figure 11:
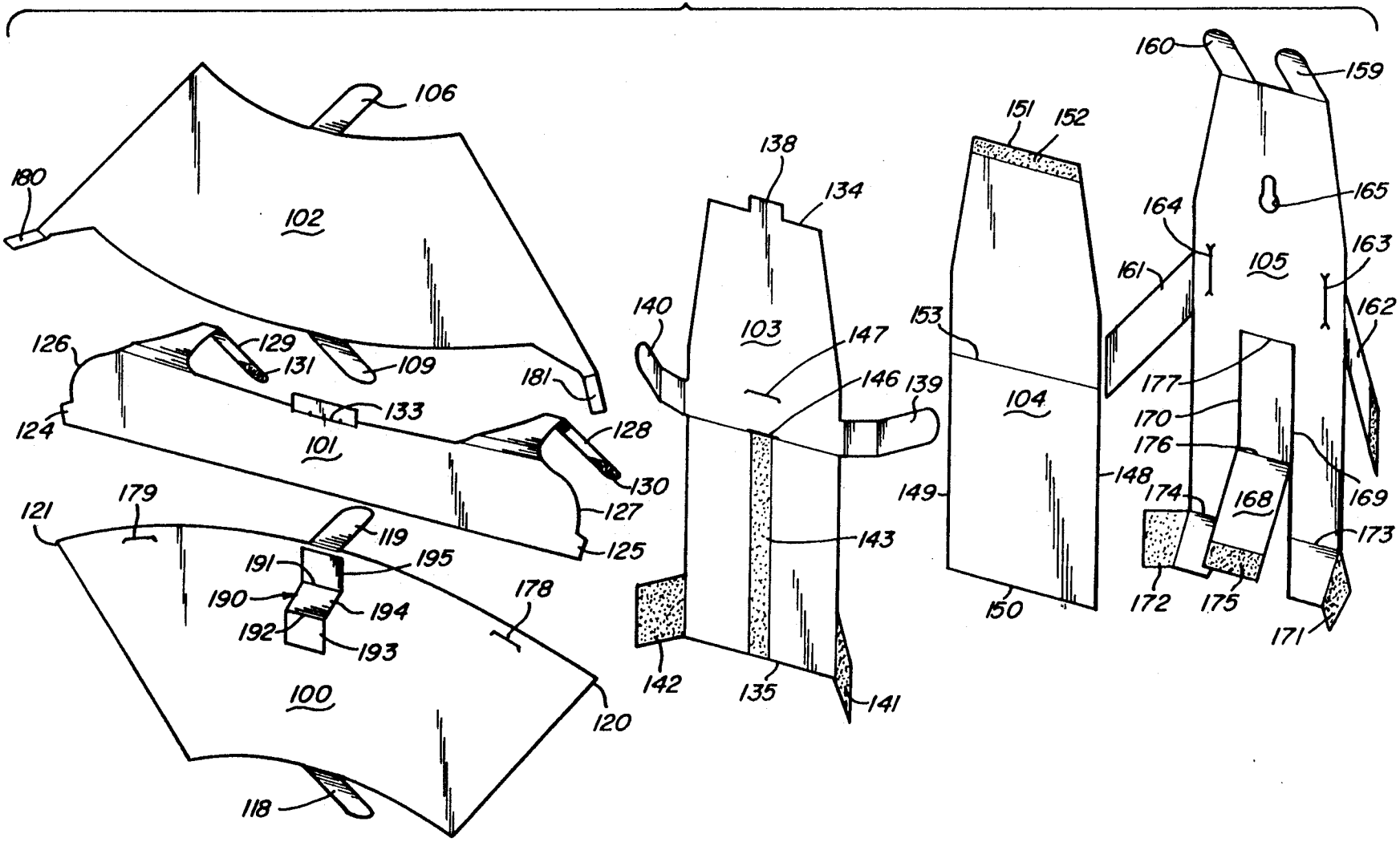
FIG. 11 is a front perspective view of the components of FIG. 10 in proper relationship and partially folded for assembly.
Figure 12:
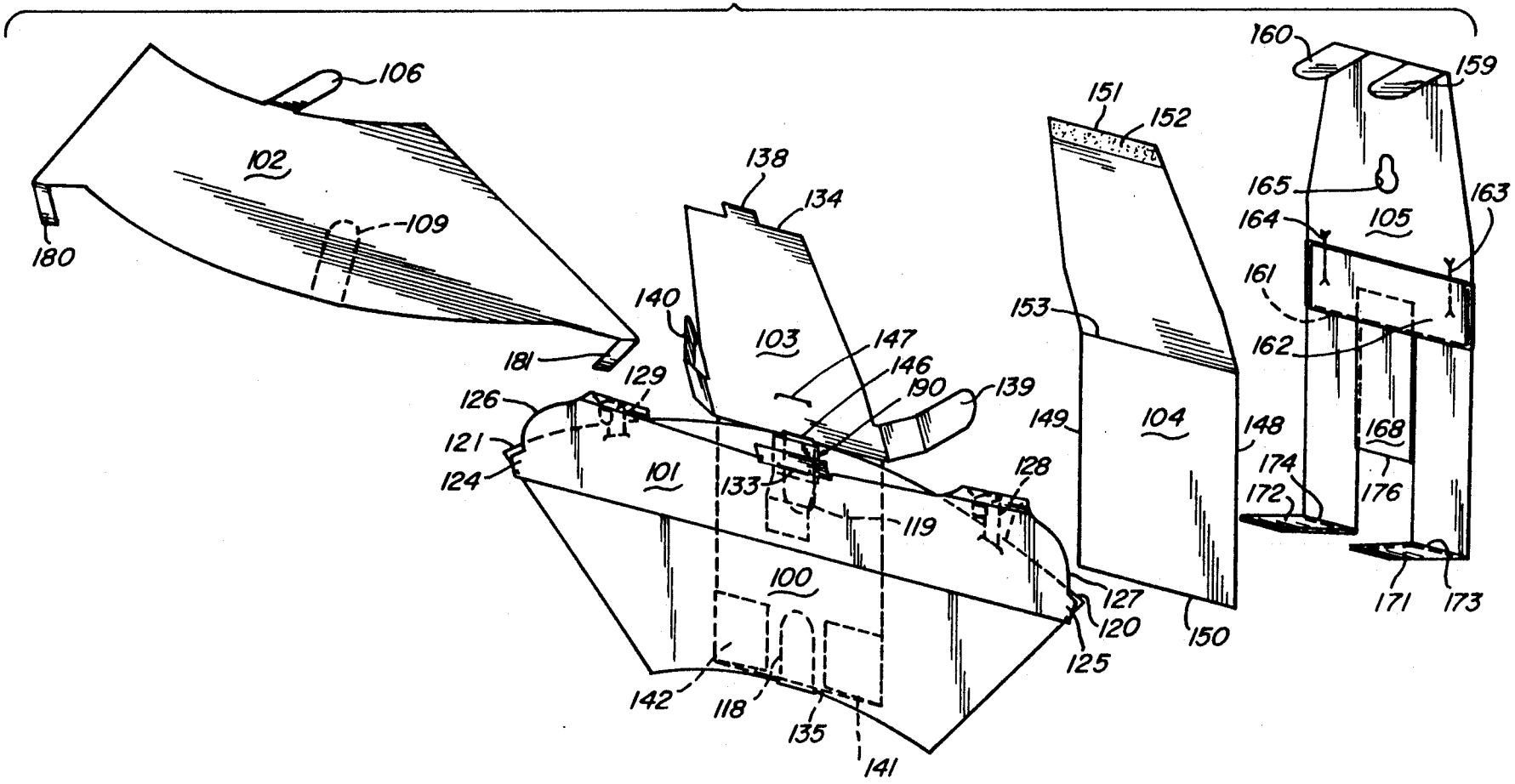
FIG. 12 is a front perspective view of the components of FIG. 10 folded and partially assembled.

Assembly of the stand-alone display is illustrated in FIG. 11 showing the components spaced in proper relationship and partially folded and in FIG. 12 showing the components folded and partially assembled. The full constructed device is shown in FIGS. 5–9.

To assemble the same, lower portion 100 is placed on top of inner support 103, upper tab 119 is inserted through lower slot 146, and the back of lower portion 100 is glued to the center adhesive strip 143 on the front of inner support 103. Intermediate portion 11 is then attached to lower portion 11 by center tab 190 and right and left tabs 128 and 129. Center tab 190 is divided into left portion 193, center portion 194, and right portion 195, by left fold line 191 and right fold line 192. Intermediate portion 101 is attached to lower portion 100 by glueing left portion 193 to the back of the intermediate portion and right portion 195 to the front of lower portion 100, and further by inserting right and left tabs 128 and 129 through right and left slots 178 and 179 respectively of lower portion 100 from the back and gluing the right and left tab end portions 130 and 131 to the back of intermediate portion 101. Next, lower tab 109 of upper portion 102 is inserted through the center slot 133 from the front of intermediate portion 101 and then tab 109 is inserted through upper slot 147 from the front of inner support 103 and glued to the back of inner support 103. Next, upper tab 106 on upper portion 102 is glued to the back of upper tab 138 on inner support 103. Lower tab 118 on lower portion 101 is glued to the back of inner support 103 adjacent the center of lower edge 135. Right and left lower tabs 141 and 142 are folded in and glued to the front of inner support 103 to provide additional stiffness to the display stand at the bottom of inner support 143. Right and left rear corner adhesive strips 120, 121 are glued to the front of left and right tabs 180 and 181 of lower portion 100 respectively to secure the upper and lower portions 102 and 100 at their outer side edges. The left and right side edges 124 and 125 of intermediate portion 101 lie on top of the left and right upper corners of lower portion 100 and are retained thereby by these outer side connections. Left and right side edges 126 and 127 of intermediate portion 101 are cut away so they cannot be seen from the front of the display device.

The optional intermediate flap 104 is attached to the back of inner support 103 along the upper adhesive strip 152 adjacent upper edge 151. Intermediate flap 104 has right and left side edges 148 and 149, lower edge 150, and a center fold line 153 to accommodate the collapsed state of the pop-up. Printed information or advertisements may be provided on this flat intermediate flap.

Figure 8:
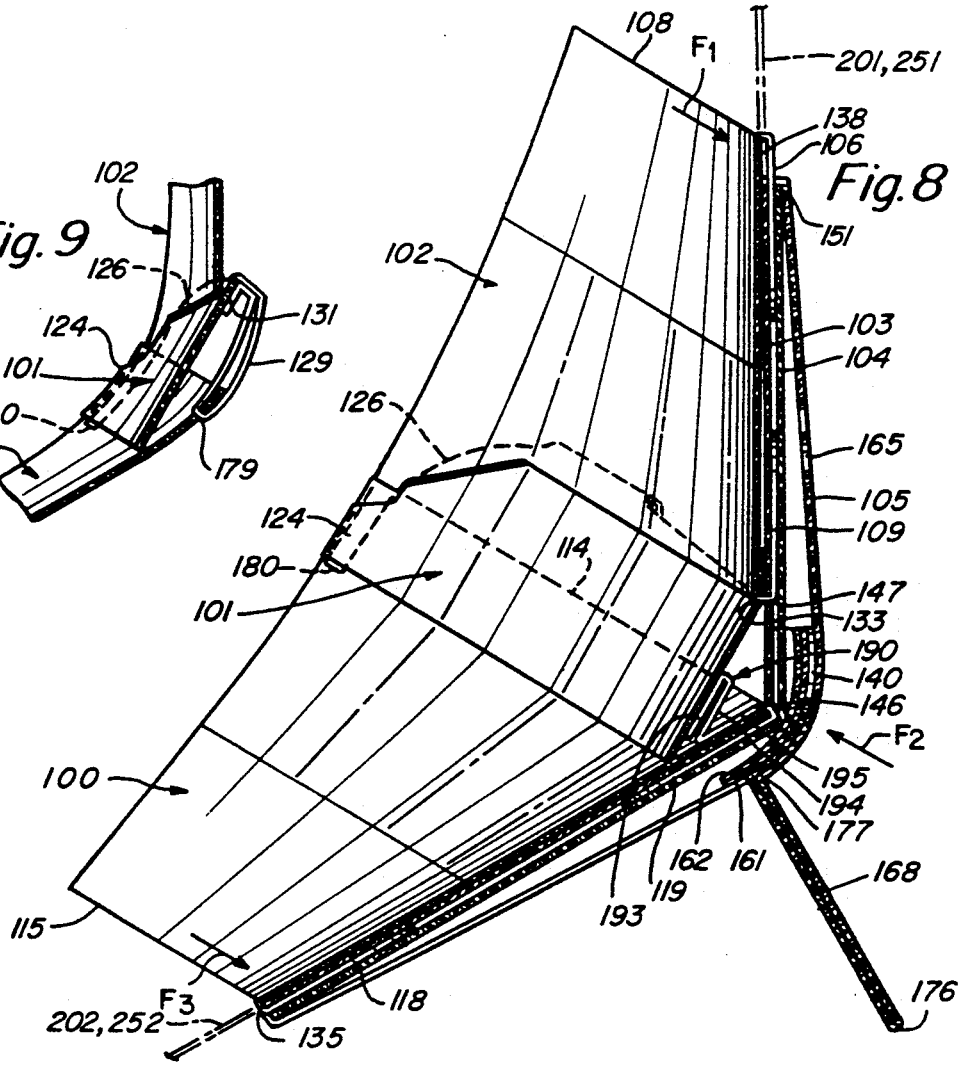
FIG. 8 is a cross-sectional view taken along the section lines 8—8 of FIG. 5; the phantom lines show the pop-up fully open.

Outer support 105 includes a lower center tab 168 defined by right and left slits 169 and 170. Tab 168 is folded up at lower fold line 176 and lower adhesive strip 175 on the bottom of tab 168 is glued to the front of outer support 105. Left and right center tabs 161 and 162 have been folded over at fold lines 161*a* and 162*a* the front of outer support 105 and the opposing tab and glued in place. The lower ends of outer support 105 are folded upward at right and left lower fold lines 173 and 174 to define flaps which are placed in front of folded tabs 141 and 142 on inner support 103, and right and left flaps 171 and 172 on outer support 105 are folded inward at fold lines 171*a* and 172*a* and glued to thus attach the lower ends of outer support 105 and inner support 103. At the upper end, right and left upper flaps 159 and 160 are folded forward at fold lines 159*a* and 160*a* and inserted in front of upper edge 134 of inner support 103 adjacent either side of upper tab 138. Outer support 105 is further secured in position by folding at fold lines 139*a* and 140*a* and inserting right and left center tabs 139 and 140 of inner support 103 through right and left slots 163 and 164 from the back of outer support 105. Center tab 168 of outer support 105 can be folded back at center fold line 177 to act as a back rest for the support structure. Alternatively, pin hole 165 in outer support 105 receives a pin, hook, or other means for attaching the display device to a wall or other support structure. As shown in FIG. 8, the inner and outer supports 103, 105 apply forces $F_1$, $F_2$ and $F_3$ at the upper edge 108 of the upper portion, the upper edge 114 of the lower portion, and the lower edge 115 of the lower portion for maintaining the display device 99 in an expanded state.

Magazine And Greeting Card Pop-Ups

FIGS. 13–20

In alternative embodiments, the pop-up 99 is disposed between the pages of a magazine, greeting card, or similar article having a bound or folded edge. This embodiment requires only four of the previously described components, namely, upper portion 102, intermediate portion 101, lower portion 100 and optionally, center tab 190. For example, as shown in FIGS. 13–17, magazine 200 has first page 201 and second page 202 adjacent one another and joined by fold line 213 (or alternatively a binding). Slots 204, 205, 206 and 207 are provided in pages 201–202 as shown in FIG. 16 for receiving tabs 106, 109, 119 and 118 on pop-up 99. The lower, intermediate and upper portions 100–102 are connected together as previously described. Lower tab 118 of lower portion 100 is inserted in slot 207. Upper tab 119 of lower portion 100 is inserted in slot 206. Lower tab 109 of upper portion 102 is inserted through center slot 133 and then slot 205. Upper tab 106 of upper portion 102 is inserted through slot 204. The tabs are then glued to the back of the page. In this manner, when the reader opens up the magazine to display pages 201 and 202, the pop-up display is automatically moved into its expanded position to display the picture or other information on its inner surface (FIG. 13). The fully folded magazine is shown in cross section in FIGS. 14–15 and the partially open magazine in FIGS. 16–17 to show how the pop-up 99 collapses between pages 201–202. Alternatively, the tabs 106, 109, 118 and 119 could be omitted, with portions 100, 102 being glued internally instead of through slots to provide a better appearance.

In a further alternative embodiment, the pop-up device is provided as part of a greeting card, brochure, or the like (FIGS. 18–20). In this embodiment the pop-up display is attached between two pages as described in the previous magazine embodiment, but in addition certain punch-out components are provided to enable the user to convert the pop-up display device within the card to a stand-alone device. Note: the magazine display device could likewise be provided as punch-out components. Similar to the previous embodiment, greeting card 251 has first page 251, second page 252, fold line 253, and slots 254–257. The pop-up display is attached to the first and second pages by inserting tabs through the slots 254–257. Alternatively, the tabs could be omitted with portions 103, 102 glued internally as previously described. In addition, on pages 251–252 there are provided punch-out perforations to define inner support 259 (similar to inner support 103), outer support 260 (similar to outer support 105), and in addition, rectangular portion 261. Rectangular portion 261 is attached at its center to the front of outer support 261 to form left and right center tabs insertable in slots 263 and 264 (similar to 161 and 162 of outer support 105). By punching out the inner and outer supports 259 and 260, the user can thus disengage the pop-up display from the greeting card 250 and assemble the same as a stand-alone device as previously described.

Method of Making Mechanical For A Pop-Up

The pop-up 99 is a collapsible display device which preferably has a reproduction of a panoramic scene or other display thereon. The following set of instructions, in addition to those in the previous methods of geometrical layout, is for making the mechanical for a pop-up.

(a) Lower edge 107 of upper portion 102 is coincident with the arc having the longer radius mentioned at step 18 (or the "shorter" radius arc cut at 29m).

(b) Right and left side edges 110, 111 of upper portion 102 and right and left side edges 116, 117 of lower potion 100 are coincident with the outer crop lines on the crescents indicated at step 29 (or the boundaries of the subtended angle per 21m).

(c) Upper edge 114 of lower portion 100 is coincident with an arc whose radius is equal to the one with the longer radius mentioned at step 18, plus an additional length $E_2$. Where H is the height of the final intermediate strip in step 11 (or 16m) and theta is the angle in degrees of vertical tilt of the camera fixture for the upper and lower conical portions, $E_2=0.5H\div$ cos theta. Note: This is the craft method despite its use of math.

For the math method, the upper edge 114 is coincident with an arc whose radius is equal to the radius of the arc cut at 29m, plus an additional length of $E_2$($E_2$ is as in the above paragraph).

(d) To position vertically the pictures of the bottom crescent on the lower portion 100, locate the cut arc with the longer radius at step 18 (or the shorter radius at 29m) parallel with upper edge 114 but down from it by an amount equal to $E_2$ (from c above).

(e) Lower edge 122 of intermediate portion 101 is coincident with the cut edge of the intermediate strip at step 11 (or 16m) that abuts the pictures of the lower portion.

(f) Right and left side edges 125, 124 of intermediate portion 101 are coincident with right and left side edges 116, 117 of upper portion 102 but only when the pop-up is in the erected state. To determine the distance between edges 125 and 124, the intermediate portion 101 must be trimmed to fit on a full-scale model than flattened out and measured. The measurement across either the top or bottom points of 125 and 124 is given to the printer.

(g) Left and right side edges 126, 127 of intermediate portion 101 are also trimmed (to fit with a clearance within the inner edges of left and right tabs 180, 181) and measured across them for the printer.

(h) In the pop-up's erected state, upper edge 123 of intermediate portion 101 is behind lower edge 107 of upper portion 102 (when one looks into the pop-up), and is also measured to find its height from lower edge 122 for the printer. The amount that this edge overlaps upper portion 102 is subjective, needing only to be high enough behind 102 to prevent the viewer seeing a gap between 102 and 101, and to allow the pop-up to open easily without scraping with too much pressure on the inner (front) surface of inner support 103, or first and second pages 201, 202, 251, 252 during the erection process.

(i) The length of tabs 180, 181, and the angle of right and left shoulders 112, 113 of upper portion 102, depend on the desired appearance and clearance between portions 102 and 101.

(j) To notify the printer of the size relationship between the mechanical and the finished press version a simple ratio will suffice. The ratio is merely the size of any suitable feature from (a) to (q) above measured on the mechanical compared with the desired size of its corresponding feature on the press version. Merely convert the ratio to a percent and multiply any feature on the mechanical by this percent to obtain the size of the same feature on the press version.

(k) A small portion of tabs 180, 181, shoulders 112, 113, and small areas at the outer ends of upper edge 114 are outside the picture areas described by the above craft and math methods. Nevertheless, they must be covered with a picture image because they are seen on the erected pop-up. These additional images must be on the mechanicals and must be matching extensions of the pictures on the crescent portions. Although not enough of the needed images are to be found on the negatives for the upper and lower conical portions, there is enough image on the corresponding pictures for the intermediate strip. Extra prints can be made of the intermediate strip's end pictures from which to extract the needed images.

(l) For any artistic or mechanical need, pictures need not be butted as indicated in steps 10 and 28m but may be separated by mullions or space. Suitable mathematical adjustments are required to accommodate the extra spacings.

The display device of this invention can serve other functions as well, such as a scoop, kite, container, retainer, or the like, as well as a display. Furthermore, the device may be translucent or transparent. In each embodiment the match lines may be retouched out, or panels may be separated by mullions, either of air or material.

Although certain preferred embodiments of this invention have hereinbefore been described, it will be appreciated that variations of this invention will be perceived by those skilled in the art, which variations are nevertheless within the scope of this invention as defined by the claims appended hereto.

What is claimed is:

1. A display device comprising:

at least three portions, including an intermediate portion disposed between an upper portion and a lower portion and means for connecting the upper, intermediate and lower portions together;

the intermediate portion comprising a cylindrical segment having a cylindrical surface and a cylindrical axis;

the upper and lower portions each comprising segment having a conical axis which with the cylindrical axis and having a conical surface which is disposed at an obtuse angle to the cylindrical surface:

wherein the surfaces of the upper, intermediate and lower portions are curved and angled to create an illusion of a generally hemispherical display surface.

2. The display device of claim 1, further comprising a displayed image on the generally hemispherical display surface.

3. The display device of claim 2, wherein the displayed image is a composite display comprising a series of photographs along each of the upper intermediate and lower portions which are matched along their edges to form a continuous image.

4. The display device of claim 2, wherein the displayed image comprises a reproduction of a composite display comprising a series of photographs along each of the upper, intermediate and lower portions which are matched along their edges to form a continuous image.

5. The display device of claim 2, wherein the displayed image encompasses a visual span of at least about 5° about the cylindrical axis and at least about 5° about an axis perpendicular to the cylindrical axis.

6. The display device of claim 1, further comprising additional conical segments provided adjacent the upper and lower portions.

7. The display device of claim 1, wherein the connecting means enables the three portions to be moved from an expanded position wherein the portions form the generally hemispherical display surface to a collapsed position wherein the device is substantially flat.

8. The display device of claim 7, further comprising means for mounting the device between adjoining faces of two flat sheets bound along one edge, or of one flat sheet folded, wherein the device is movable to its expanded position when edges of the sheets other than the one edge are separated.

9. The display device of claim 7, further comprising means for retaining the device in its expanded position.

10. The display device of claim 9, wherein the retaining means includes means for supporting the device as a stand-alone device on a horizontal surface.

11. The display device of claim 9, wherein the retaining means includes means for supporting the device against a vertical or inclined surface.

12. The display device of claim 7, wherein the device has a pair of opposing outer side edges aligned substantially along the direction of the cylindrical axis and the connecting means includes a first means for connecting the upper and lower portions adjacent the side edges of the device.

13. The display device of claim 12, wherein the connecting means includes a second means for connecting the upper portion and the intermediate portion.

14. The display device of claim 13, wherein the connecting means includes a third means for connecting the intermediate portion and the lower portion.

15. The display device of claim 14, wherein the intermediate portion has an upper edge adjacent the upper portion and the upper edge of the intermediate portion is disposed behind the upper portion in the expanded position.

16. The display device of claim 15, wherein the intermediate portion has a lower edge adjacent the lower portion and the lower edge of the intermediate portion is disposed in front of the lower portion in the expanded position.

17. The display device of claim 16, further comprising means for retaining the member in its expanded position.

18. The display device of claim 17, wherein the retaining means applies restraining forces at an upper edge of the upper portion and a lower edge of the lower portion.

19. The display device of claim 18, wherein the retaining means also applies restraininq forces at an upper edge of the lower portion.

20. The display device of claim 17, wherein the retaining means applies restraining forces at the upper edge of the intermediate portion and a lower edge of the lower portion.

21. The display device of claim 7, made of a sheet material.

22. The display device of claim 21, wherein the sheet material is selected from the group consisting of paper, plastic, fiber, metal, wood, or a composite material.

23. The display device of claim 7, provided as detachable members on a sheet of material.

24. A method of making a panoramic display device comprising:

taking a first series of overlapping pictures while a camera having a fixed axis in a first direction is pivoted to spaced positions along a second direction which is perpendicular to the first direction;

taking a second series of overlapping pictures while the camera, after being tilted upwardly to a first predetermined angle with respect to the first axis, is again pivoted to the spaced positions along the second direction.

taking a third series of overlapping pictures while the camera, after being tilted downwardly to a second predetermined angle with respect to the first axis, is again pivoted to the spaced positions along the second direction;

providing a hemispherical display surface comprising at least three planar portions, including an intermediate portion disposed between an upper portion and a lower portion and means for connecting the upper, intermediate and lower portions together;

the intermediate portion comprising a cylindrical segment having a planar cylindrical surface and a cylindrical axis;

the upper and lower portions each comprising a conical segment having a conical axis which is coaxial with the cylindrical axis and having a planar conical surface which is disposed at an obtuse angle to the planar cylindrical surface;

wherein the planar surfaces of the upper, intermediate and lower surfaces are curved and angled to create an illusion of a generally hemispherical display surface; applying the first, second and third series of pictures to the intermediate, upper and lower portions respectively of the hemispherical display surface; and joining the pictures together, side-to-side or top-to-bottom, at their shared match lines to create a composite display.

25. The method of claim 24, wherein the first and second predetermined tilt angles are equal.

26. The method of claim 25, wherein the tilt angles and the pivot angles are equal.

27. The method of claim 24, wherein the camera is tilted and pivoted about a nodal point of the camera lens.

28. The method of claim 24, wherein the match lines between adjacent pictures are determined by the use of moiré interference patterns.

29. The method of claim 24, wherein the match lines between adjacent pictures are determined by the use of a geometrical layout.

30. The method of claim 24, wherein the match lines between adjacent pictures are determined by sliding transparent images across one another.

* * * * *

UNITED STATES PATENT AND TRADEMARK OFFICE

CERTIFICATE OF CORRECTION

PATENT NO. : 5,083,389

DATED : January 28, 1992

INVENTOR(S) : Alperin

It is certified that error appears in the above-identified patent and that said Letters Patent is hereby corrected as shown below:

Col. 6, line 66, after "angle" insert -- . --

Col. 7, line 66, delete "overlying" and substitute -- overlapping --.

Col. 10, line 38 delete "adjust" and substitute -- just --.

Col. 11, line 4, delete "printer s" and substitute -- printer's --.

Col. 12, line 12, delete "strip s" and substitute -- strip's --; line 35, delete "there" and substitute -- theta --; line 36, delete "an" and substitute -- as --.

Col. 13, line 39, delete "pictures" and substitute -- picture. Cut --.

Col. 14, line 65, delete "full" and substitute -- fully --.

Col. 15, line 2, delete "11" and substitute -- 101 --; line 3, delete "11" and substitute -- 100 --; line 26, delete "143" and substitute -- 103 --; line 49, delete "161*la*" and substitute -- 161*a*.

Col. 16, line 21, delete "213" and substitute -- 203 --; line 54, delete "251" (first occurrence) and substitute -- 250 --; line 58 delete "103" and substitute -- 100 --; line 64 delete "261" and substitute -- 260 --.

Col. 17, line 45 delete "than" and substitute -- then --.

UNITED STATES PATENT AND TRADEMARK OFFICE

CERTIFICATE OF CORRECTION

PATENT NO. : 5,083,389

DATED : January 28, 1992

INVENTOR(S) : Alperin

It is certified that error appears in the above-identified patent and that said Letters Patent is hereby corrected as shown below:

Col. 18, line 4, delete "(q)" and substitute -- (g) --; line 51 after "comprising" insert -- a conical --; line 52 after "which" insert -- is coaxial --.

Col. 19, line 63 delete "restrainiqq" and insert -- restraining --.

Signed and Sealed this

Third Day of August, 1993

*Attest:*

Michael K. Kirk

MICHAEL K. KIRK

*Attesting Officer*

*Acting Commissioner of Patents and Trademarks*